United States Patent [19]

Arikawa

[11] 4,404,537

[45] Sep. 13, 1983

[54] QUICK-ACTING FUSE

[75] Inventor: Hiroo Arikawa, Tokyo, Japan

[73] Assignee: San-O-Industrial Corp., Tokyo, Japan

[21] Appl. No.: 357,982

[22] Filed: Mar. 15, 1982

Related U.S. Application Data

[63] Continuation of Ser. No. 131,075, Mar. 17, 1980, abandoned.

[51] Int. Cl.[3] ..... H01H 85/16

[52] U.S. Cl. ..... 337/232; 337/231; 337/295

[58] Field of Search ..... 337/232, 231, 295, 297, 337/290; 29/623

[56] References Cited

U.S. PATENT DOCUMENTS 3,348,007 10/1967 Urani ..... 337/232

*Primary Examiner*—Harold Broome

[57] ABSTRACT

A quick-acting fuse comprising a fuse base encased within an insulated fuse cartridge. The fuse base consists of a lower insulating plastic (phenolic) plate and an upper conductive metal (copper) plate coextensively bonded to the lower plate. The fuse base has an enlarged mid-section of generally hexagonal or polygonal configuration which necks down on both sides to a pair of projecting arms whose ends are soldered to end caps used to seal the fuse cartridge when the fuse base is placed therein. The mid-section of the fuse has a generally elliptical hole and the upper metallic plate is partially etched away around said hole so as to provide a pair of spaced-apart and opposed conductive terminals. A pair of opposed grooves is provided, one at each end of said conductive terminals, and a fusible element is stretched between said grooves across said generally elliptical hole. A solder pool is provided next to each groove for quantitative soldering the ends of the fusible element.

8 Claims, 6 Drawing Figures

QUICK-ACTING FUSE

FIELD OF INVENTION This is a continuation of application Ser. No. 131,075 filed Mar. 17, 1980 now abandoned.

This invention relates to quick acting fuses and is particularly related to a quick-acting fuse which has improved reliability, thermal stability and current interrupting capability.

BACKGROUND OF THE INVENTION

A variety of fuses are presently employed for protecting different electrical and electronic circuitries. The primary function of the fuse is to protect these circuits against damage or destruction when an overload current, i.e., a current in excess of the rated capacity of the fuse, flows through the circuit. In order to prevent such damage or destruction, the fuses must act quickly and effectively to interrupt the overload current. The quicker the current interrupting action, the more effective is the fuse under such conditions.

A variety of quick-acting fuses are known and some have been used as protectors for various electric circuits. In the construction and operation of some of these fuses, it is customary to have a fuse link securely stretched between the two electrically conductive terminals. However, and as is often the case in fuses which are designed for carrying low currents, the fuse links are generally not strong enough physically to support themselves within the casing. As disclosed in U.S. Pat. No. 2,577,405 issued on Nov. 27, 1951 to Craig L. McAlister, when an overload current passes through this type of fuse, the fuse links are heated causing them to elongate and bend until they contact the casings of the fuse thus resulting in an unreliable rating of the fuse. In order to overcome this difficulty, the protectors have been provided with bridge structure's to support the fusible links and prevent their accidental contact with the interior of the casing of the protector. However, for reasons discussed in the aforementioned McAlister patent, the provision of such bridge structures have not been entirely satisfactory and, therefore, McAlister provides and discloses a protector for electric circuits which has a rigid support that directly supports the fuse link, said support having a conductive coating at each end to which the ends of the fusible link can be secured. The conductive coating used by McAlister consists of a first silver coating adherent to the rigid support and a copper coating adherent to the silver coating. The first coating is usually applied by brushing a conductive solution of silver on the rigid support and the second coating is generally formed by dipping the silver-coated rigid support in a colloidal suspension of copper. It can be appreciated, therefore, that these techniques are rather cumbersome ways of providing conductive coatings for the rigid supports, and are therefore uneconomical.

Moreover, the fusible link in McAlister is stretched at an angle with respect to the long axis of the protector further complicating the manufacture of the fuse.

Japanese Patent No. 41-17949 describes a fuse comprising a fuse base made of an insulating base and two electrically conductive terminals, one bonded to one side of the insulating base and the second bonded to the other side thereof. A small hole is punched through the middle of the insulating base and a fusible link is passed through said hole. However, these fuses are also difficult to fabricate and do not satisfactorily overcome the aforementioned difficulties.

The present invention constitutes a further improvement in the manufacture and operation of quick acting fuses by providing a protector which overcomes the aforementioned difficulties while improving the current interrupting capacity of the fuse.

It is therefore an object of the present invention to provide a protector for electric circuits which is quick acting and exhibits stable and reliable performance.

It is a further object of this invention to provide a quick acting fuse which can be readily mass produced.

It is still another object of this invention to provide a quick acting fuse in which the fuse link is securely stretched between the conductive terminals of the fuse and which exhibits excellent reliability and thermal stability.

The foregoing and other objects of this invention will become more evident from the following detailed description of the invention and the accompanying drawings which form a part of this application.

SUMMARY OF THE INVENTION

In accordance with this invention, a quick acting fuse is provided for protecting electric circuits which fuse exhibits improved stability, reliability and arc-extinguishing characteristic due to uniqueness of its construction and operation.

The unique fuse of the present invention comprises a fuse base structure which consists of an insulating plastic (e.g., phenolic plate and adherent conductive metal (e.g., copper) coating thereon. The fuse base structure has an enlarged mid-section which necks down on two sides to define a pair of projecting arms whose ends are soldered to end caps used to seal the fuse cartridge when the fuse base structure is placed within the cartridge. A generally elliptical hole is provided in the mid-section of the fuse base, and the metallic coating is partly etched away to the base surface of the insulating plate, the etched out portion extending around said elliptical hole so as to provide a pair of spaced-apart and opposed conductive terminals. A groove is provided at the end of each conductive terminal near the etched out surfaces and a fusible element is stretched out between said grooves across said generally elliptical hole.

A solder pool is provided next to each groove for quantitatively soldering the ends of the fusible element which may be secured or embedded into said grooves.

BRIEF DESCRIPTION OF THE DRAWINGS

In the drawings, wherein like reference numerals are employed to designate like parts.

DETAILED DESCRIPTION OF THE PREFERRED EMBODIMENT OF THE INVENTION

Figure 1:
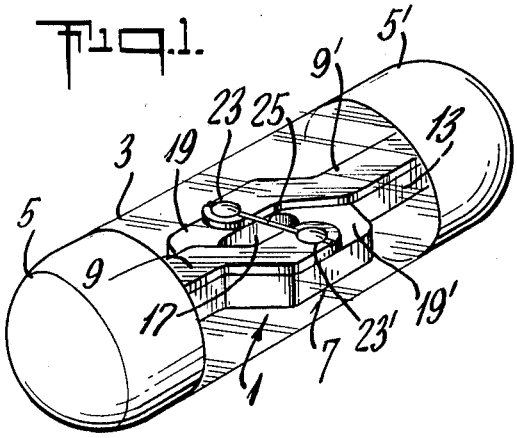
FIG. 1 is a perspective view of the fuse of the invention.
Figure 2:
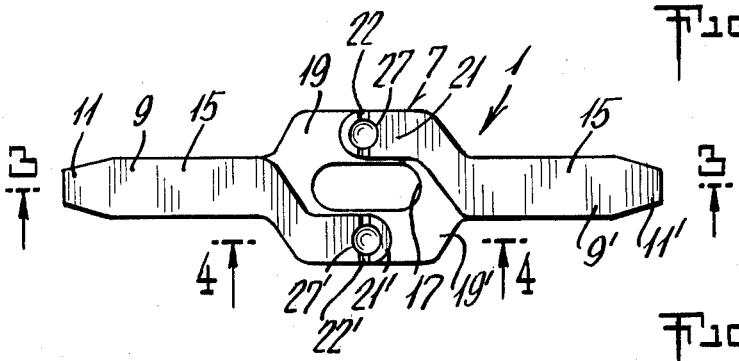
FIG. 2 is a plan view of a fuse base made in accordance with this invention and used in making the fuse shown in FIG. 1.
Figure 3:
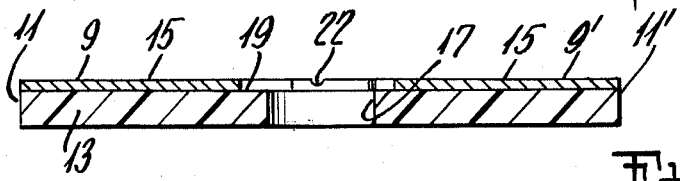
FIG. 3 is a sectional view taken along the line 3—3 in FIG. 2.
Figure 4:
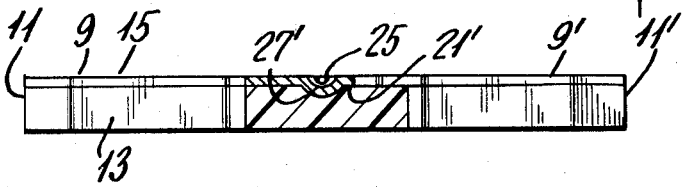
FIG. 4 is another sectional view but taken along the line 4—4 in FIG. 2.

Referring to the drawings, and with particular reference to FIGS. 1 and 2, the fuse of this invention comprises a fuse base generally designated as 1 disposed within an insulated fuse cartridge such as a glass tube 3 capped at both ends by means of end caps or ferrules 5,5' as shown in FIG. 1. The fuse base 1 which is illustrated in detail in FIG. 2, and which has the general configuration shown therein, has its mid-section enlarged as at 7 having a generally hexagonal or polygonal configuration which necks down on both sides of the major axis of the base, to define a pair of projecting arms 9,9' whose respective ends 11,11' may be tapered, if desired, and are soldered to the end caps or ferrules 5,5', respectively, when the fuse base is inserted into the fuse casing or cartridge 3.

In its preferred construction, the fuse base 1 consists of an insulating plate 13, preferably made of a suitable phenolic resin capable of withstanding the heat generated by the flow of electrical current, coated with a copper plate 15, or some other conductive metal. The copper plate 15 may be adhesively bonded to the phenolic insulating plate 13, or it may be coated thereon by other well known methods to form an adherent coating of the conductive metal on the insulating plate. It is thus apparent that the fuse base structure lends itself to ready mass fabrication and production in commercial quantities.

Figure 5:
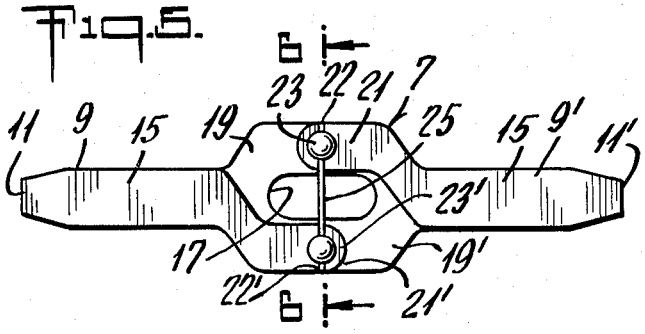
FIG. 5 is a plan view of the fuse base similar to FIG. 2 but wherein a fusible element is stretched between the fuse terminals across the fuse base.
Figure 6:
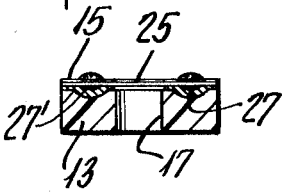
FIG. 6 is a sectional view taken along the line 6—6 in FIG. 5.

As is further illustrated in FIGS. 2 and 5, a generally elliptical hole 17 is punched or drilled through the mid-section 7 of the fuse base structure, substantially at the center thereof, and the copper plate 15 is partly etched away as at 19,19' to the bare surface of the insulating plate 13. By etching away portions of the copper plate 15 and providing the hole 17 as previously described, the fuse base structure is provided with a pair of spaced apart and opposed conductive terminals 21,21'. A pair of opposed grooves 22,22' each provided at the conductive terminals 21,21' near the etched out areas 19,19' serve to anchor and secure a fusible link 25 which is stretched between said terminals and across the generally elliptical hole 17. Solder-receiving wells or recesses 27,27' are provided adjacent each of said grooves 22,22' for soldering the ends of the fusible link 25 to complete the electric circuit within the fuse.

Preferably, the cross sectional areas of the grooves 22,22' are greater than the cross sectional area of the fuse link 25 so that the ends of the fuse link can be inserted or embedded into their respective grooves.

The solder-receiving wells 27,27' are filled with a solder material 23,23' not only to complete the electric circuit in the fuse but to insure quantitatively accurate soldering so as to maintain a constant level of thermal capacity at the soldered joints.

As it is apparent from the foregoing description, a fuse constructed and used in accordance with the principles of this invention constitutes an improvement over the prior art fuses which are employed for similar purpose. Also, while the fuse of this invention has been described and illustrated in the drawings with a certain degree of particularity, it is nevertheless apparent from this description that several changes and modifications may be made in its construction which are nevertheless contemplated by and are, therefore, within the scope of this invention.

What is claimed is:

1. A quick-acting fuse comprising a fuse base encased within an insulated cartridge, said fuse base consisting of a lower insulating plastic layer and an upper conductive metallic layer coextensively bonded to said lower layer; said fuse base having an enlarged mid-section, a generally elliptical hole in said mid-section, said mid-section necking to a pair of laterally projecting arms on both sides thereof, the ends of said arms being soldered to end caps used to seal the ends of said insulated cartridge, and wherein said metallic layer is partly etched away around said hole to define a pair of spaced apart and opposed conductive terminals with curved tips, a pair of opposed grooves, one in each of said conductive terminals, and a fusible element stretched between said grooves, across said elliptical hole in said fuse base essentially perpendicular to the longitudinal axis of said fuse base.

2. A fuse as in claim 1 wherein a solder-receiving pool is provided at each of said terminals, adjacent each of said grooves, for soldering the respective ends of said fusible element.

3. A fusible element as in claim 1 wherein said lower layer of said fuse base is made of phenolic resin and said upper layer is made of copper.

4. A fuse as in claim 2 wherein said lower layer of said fuse base is made of phenolic resin and said upper layer is made of copper.

5. A fuse as in claim 1 wherein the cross sectional area of said grooves is greater than the cross sectional area of said fusible element and wherein the ends of said fusible element are secured in said grooves.

6. A fuse as in claim 2 wherein the cross sectional area of said grooves is greater than the cross sectional area of said fusible element and wherein the ends of said fusible element are secured in said grooves.

7. A fuse as in claim 3 wherein the cross sectional area of said grooves is greater than the cross sectional area of said fusible element and sherein the ends of said fusible element are secured in said grooves.

8. A fuse as in claim 4 wherein the cross sectional area of said grooves is greater than the cross sectional area of said fusible element and wherein the ends of said fusible element are secured in said grooves.

* * * * *